US006941977B2

(12) United States Patent
Reiter

(10) Patent No.: US 6,941,977 B2
(45) Date of Patent: Sep. 13, 2005

(54) JACQUARD MACHINE

(75) Inventor: Joseph Nikolaus Reiter, St. Vith (BE)

(73) Assignee: Textilma AG, Hergiswil (CH)

( * ) Notice: Subject to any disclaimer, the term of this patent is extended or adjusted under 35 U.S.C. 154(b) by 177 days.

(21) Appl. No.: 10/240,293

(22) PCT Filed: Mar. 7, 2001

(86) PCT No.: PCT/CH01/00142

§ 371 (c)(1),
(2), (4) Date: Feb. 25, 2003

(87) PCT Pub. No.: WO01/73177

PCT Pub. Date: Oct. 4, 2001

(65) Prior Publication Data

US 2003/0164198 A1 Sep. 4, 2003

(30) Foreign Application Priority Data

Mar. 27, 2000 (CH) ..... 584/00

(51) Int. Cl.[7] ..... D03C 13/00
(52) U.S. Cl. ..... 139/455; 139/59
(58) Field of Search ..... 139/68, 71, 85, 139/59, 455

(56) References Cited

U.S. PATENT DOCUMENTS 5,462,097 A * 10/1995 Skalka ..... 139/455
5,666,999 A * 9/1997 Dewispelaere et al. ..... 139/455
5,743,308 A 4/1998 Bassi et al.

FOREIGN PATENT DOCUMENTS

| | | |
|---|---|---|
| DE | 26 40 727 B1 | 9/1976 |
| EP | 0 154 823 A1 | 8/1995 |
| EP | 0 779 384 A1 | 8/1997 |
| EP | 0 884 410 A1 | 12/1998 |
| EP | 0 930 384 A1 | 7/1999 |
| WO | WO 92/16678 | 10/1992 |
| WO | WO 99/11850 | 3/1999 |

* cited by examiner

*Primary Examiner*—John J. Calvert
*Assistant Examiner*—Andrew W. Sutton
(74) *Attorney, Agent, or Firm*—Hovey Williams LLP

(57) ABSTRACT

Each lifter (2) has a displacement member (4) which can be connected to at least one directable thread (18) and which has two spring arms (28*a*, 28*b*) that can be coupled to lifter blades (34*a*, 34*b*) which move up and down. The lifter blades are not attached to the spring arms (28*a*, 28*b*) in the starting position of the latter. In the lower shed position (T), the spring arms (28a, 28b) can be displaced into position for coupling with the lifter blades (34*a*, 34*b*) using an actuator (40). The displacement member (4) can be locked in the upper shed position using the same actuator (40). To improve the jacquard machine, the switching member (38) is positioned at the end of a spring tongue (44) that is aligned in the direction of displacement and is fixed to the displacement member (4, 4*a*) outside the spring arms (28*a*, 28*b*). The actuator (40, 40*a*) is located laterally outside the spring arms (28*a*, 28*b*) in such a way that it acts transversely in relation to the latter.

21 Claims, 4 Drawing Sheets

JACQUARD MACHINE

TECHNICAL FIELD

The invention relates to a jacquard machine which has lifters which can be connected to threads to be controlled and which can be coupled in a form-fitting manner to oppositely ascending and descending lifting knives as a function of control signals from an electronic control device, each lifter having a displacement member which, on the one hand, can be connected to at least one thread to be controlled and, on the other hand, carries two spring arms which in the basic position are free of the lifting knives and in the lower shed position can be brought into a coupling position for the lifting knives by means of an actuator, and in the upper shed position the displacement member being interlockable by means of the actuator.

PRIOR ART

A jacquard machine of the type initially mentioned is known, for example, from U.S. Pat. No. 5,743,308. In such, a jacquard machine, the actuator, designed as an electromagnet, is arranged with a switch member between the spring arms of a two-armed lifter, this being a great disadvantage for the small form of construction which is necessary. Moreover, access is difficult to the components located between the spring arms for maintenance and setting work. Another disadvantage is that the spring arms are provided with outward-pointing locking noses which cooperate with fixed locking knives. In one example, the locking noses are prestressed interlockingly against the locking knives by the spring force of the spring arms and have to be released from the locking knives by the spring arms being bent in by means of the actuator. In a further example, the locking noses are arranged on tongue springs connected to the lifter and have to be brought into engagement with the locking knives by being spread outward by means of the actuator. Apart from the fact that the double arrangement of the locking noses and locking knives leads to a complicated construction, the resilient arrangement of the locking noses causes vibrations which are detrimental to the functioning of the jacquard machine.

PRESENTATION OF THE INVENTION

The object of the invention is to improve a jacquard machine of the type initially mentioned.

The set object is achieved by means of a jacquard machine wherein the switch member is arranged at the end of a spring tongue oriented in the direction of displacement and fastened to the displacement member outside the spring arms, the actuator being arranged laterally outside the spring arms and so as to act transversely thereto.

Since the switch member is arranged at the end of a spring tongue oriented in the direction of displacement and fastened to the displacement member outside the spring arms, the actuator being arranged laterally outside the spring arms and so as to act transversely thereto, the space between the spring arms is free of components, thus resulting in a highly space-saving and slender form of construction of the lifters. Since both the switch member and the actuator are located outside the lifter, they are accessible in a simple way for setting and maintenance work.

Advantageous refinements of the invention include the provision of at least one rigid catch arranged on the displacement member for detention in the upper shed position and with which the actuator directly cooperates. Further refinements include providing the displacement member with at least two catches arranged at different heights, preferably catch recesses for the actuator, providing the actuator as part of an electromagnet, providing the actuator as part of a piezoelectric element, providing the lifter of the jacquard machine with run-on surfaces which, in the upper shed position, keep the spring arms spread in the coupling position, providing the lifter an assigned preferably settable stop determining the lower shed position, providing the displacement member with a back part which is equipped with a guide profile and which is mounted displaceably in a guide in the machine stand, the hack part being on the side facing away from the actuator, and wherein the lifting knives are designed to execute an overmovement in the upper shed position and/or the lower shed position.

A particularly advantageous jacquard machine is obtained when at least one rigid catch, with which the actuator cooperates directly, is arranged on the displacement member for detaining the lifter in the upper shed position. This design simplifies construction, since there is only one catch which, moreover, is accessible from the outside. The rigid catch also prevents undesirable vibrations and resonances, with the result that not only is the useful life of the jacquard machine lengthened, but also higher performances are possible.

So that the height of the shed can be set, a refinement of providing the displacement member with at least two catches arranged at different heights, preferably catch recesses for the actuator is advantageous, since each locking point for interlocking the displacement member with the actuator corresponds to a defined height of the shed.

There are various possibilities for designing the actuator. First, for example, it may be designed as an electromagnet. The design wherein the actuator is designed as a piezoelectric element is more advantageous.

For coupling the spring arms in the upper shed position, there are various possibilities, the design having run-on surfaces for the spring arms in the upper shed position being particularly advantageous and simple.

A development of the jacquard machine wherein the lifter is assigned a preferably settable stop is particularly expedient, since settable stops determining the lower shed position allow a further setting of the shed.

A displacement member requires, in the machine stand, a guide for which there are various design possibilities. A particularly simple and space-saving solution is one wherein the displacement member has a back part on the side facing away from the actuator, the back part being equipped with a guide profile and which is mounted displaceably in a guide in the machine stand.

According to one preferred aspect of the invention, the lifting knives are designed in such a way that they execute some overmovement in the upper shed position and/or lower shed position, with the result that the elements to be switched are free of form-fitting engagement and/or of tensile forces and switching is made possible or at least easier.

BRIEF DESCRIPTION OF THE DRAWINGS

Exemplary embodiments of the jacquard machine according to the invention are described in more detail below with reference to the drawings in which.

Figure 1:
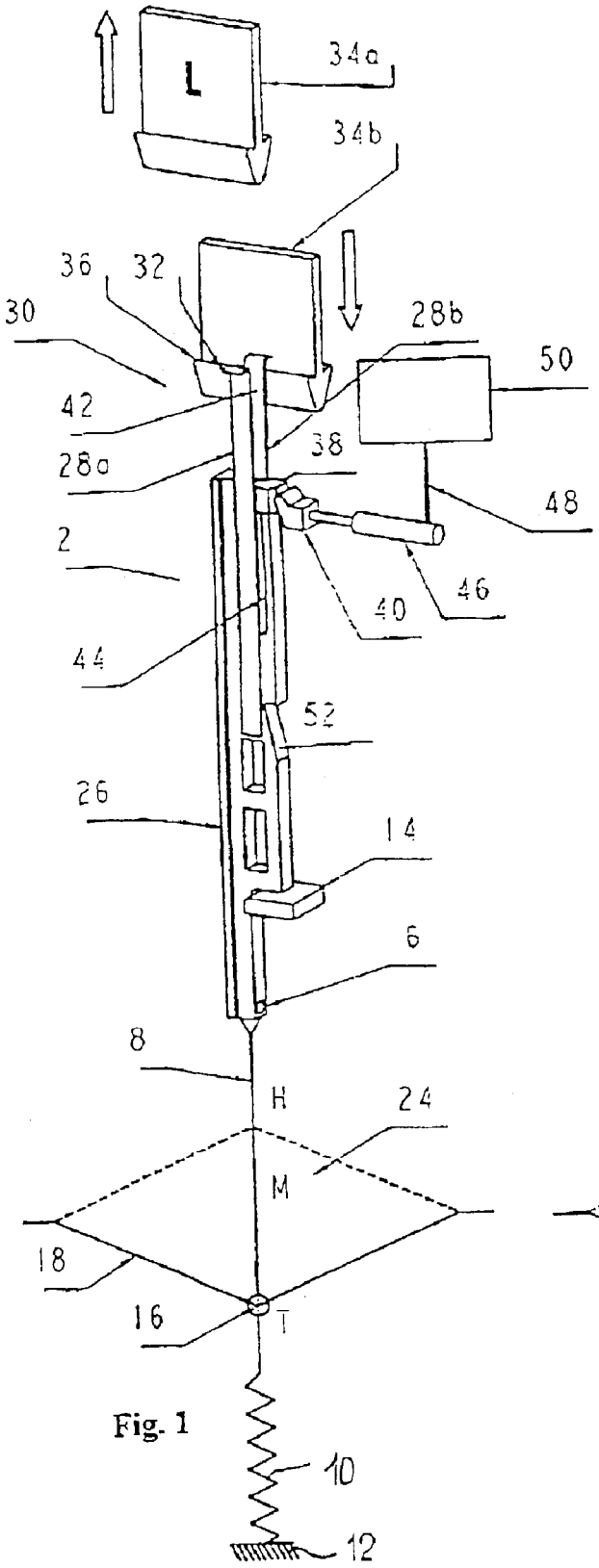
FIG. 1 shows a lifter in the lower shed position and in the basic position of the spring arms in a diagrammatic illustration.
Figure 2:
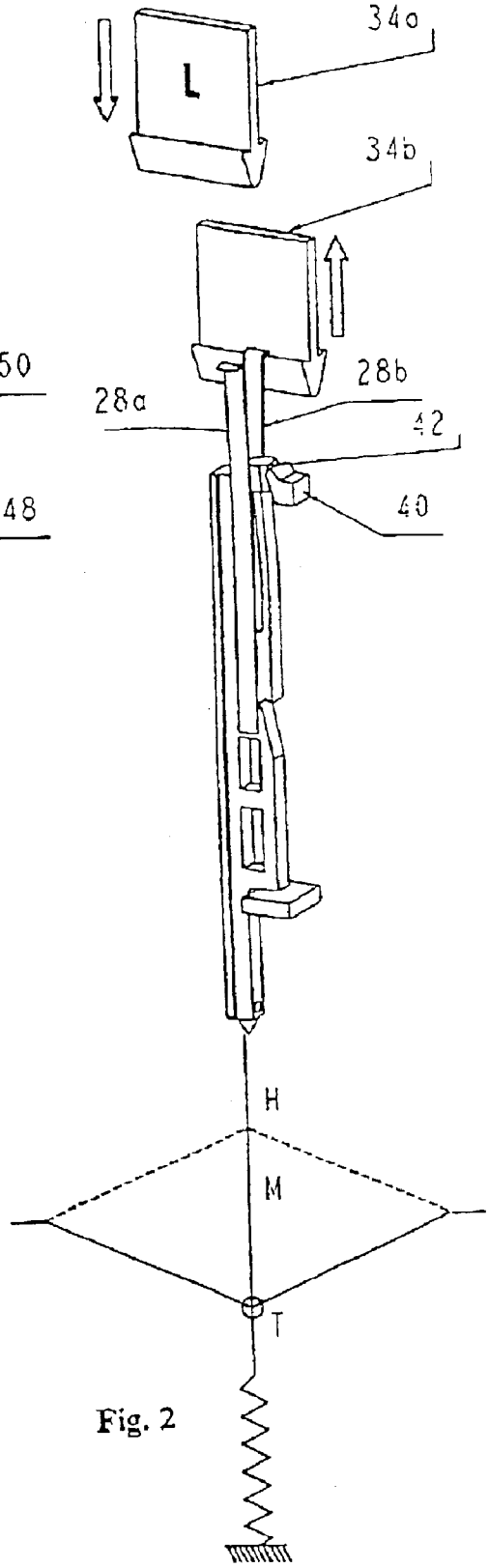
FIG. 2 shows the lifter of FIG. 1 in a coupling position of the spring arms.
Figure 3:
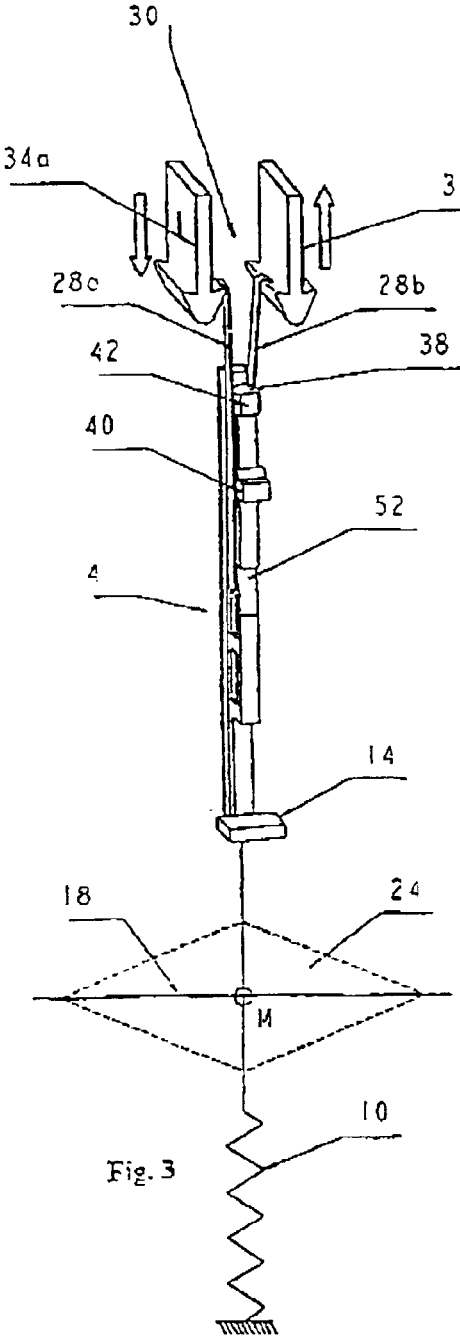
FIG. 3 shows the lifter of FIG. 1 in the middle shed position, in a modified diagrammatic illustration.

Ways of implementing the invention and commercial practicability

FIGS. 1 to 4 illustrate in a diagrammatic illustration a lifter 2 of a jacquard machine in various working positions, parts not essential for the essence of the invention being omitted.

The lifter 2 has a displacement member 4, to which is connected at the lower end, via a loop 6, a heddle 8 which is prestressed against a machine stand 12 via a spring 10. By means of this prestress, the displacement member 4 is prestressed, in the lower shed position T, against a lower stop 14 on the machine stand. An eye 16 arranged in the heddle 8 serves for the take-up of a warp thread 18, in order to move the latter back and forth out of the lower shed position T of FIG. 1 through the middle shed position M of FIG. 3 into the upper shed position H of FIG. 4 and thereby form a shed 24. The displacement member 4 is held displaceably in the longitudinal direction via a profiled back part 26 by means of a guide of the machine stand, said guide not being illustrated in any more detail here.

The displacement member 4 contains two upward-pointing spring arms 28*a* and 28*b* which contain mechanical coupling means 30 in the form of outward-pointing hooks 32 which can in each case be coupled to ascending and descending lifting knives 34*a* and 34*b* having corresponding drivers 36 for the hooks 32. The spring arms 28*a* and 28*b* assume a basic position, shown in FIG. 1, in which they are free of the lifting knives 34*a* , 34*b*, that is to say cannot be coupled without control. The displacement member 4 contains a resilient switch member 38 which can be actuated by means of a fixed actuator 40, in order to move the spring arms 28*a* and 28*b* out of the basic position of FIG. 1 into the coupling position of FIG. 2 for the lifting knives 34*a* and 34*b*. For this purpose, the switch member contains a spreading wedge 42 which is arranged at the front end of a spring tongue 44 of the displacement member 4. The actuator 40 is, for example, part of an electromagnet 46 connected via a line 48 to an electronic control device 50 which transmits a pattern-related control signal to the actuator. The displacement member 4 further contains a catch 52, in which the actuator 40 catches when the lifter 2 together with the displacement member 4 is in the upper shed position H, as may be gathered from FIG. 4.

The lifter functions as follows.

FIG. 1 shows the lifter 2 in the lower shed position T, in which it stands at the lower stop 14. The spring arms 28*a*, 28*b* are likewise in the basic position, since the switch member 38 is likewise in the basic position. In this basic position, it is not possible for the spring arms 28*a*, 28*b* to cooperate with the lifting knives 34*a*, 34*b*. When the switch member 38 is activated by the control device 50 via the actuator 40 by means of a control signal, the spreading wedge 42 of the switch member 38 is driven between the spring arms 28*a*, 28*b*, with the result that these come with their coupling means 30 into the displacement path of the lifting knives 34*a*, 34*b*. The lifter is then driven into the upper shed position by one of the lifting knives 34*a* or 34*b* which is just in the lower shed position. There is no conflict between the lifting knives 34*a*, 34*b*, since, when one lifting knife 34*a* is in the lower shed position and therefore cooperates with a spring arm, the other lifting knife is in the upper shed position, where it does not cooperate with the associated spring arm. After a spring arm is coupled to a lifting knife, the switch member 38 is drawn back. By virtue of the hook shape of the coupling means, the corresponding spring arm remains hooked together with the corresponding lifting knife, in order to raise the lifter. The free spring arm returns to the basic position, as may be gathered from FIG. 3.

Figure 4:
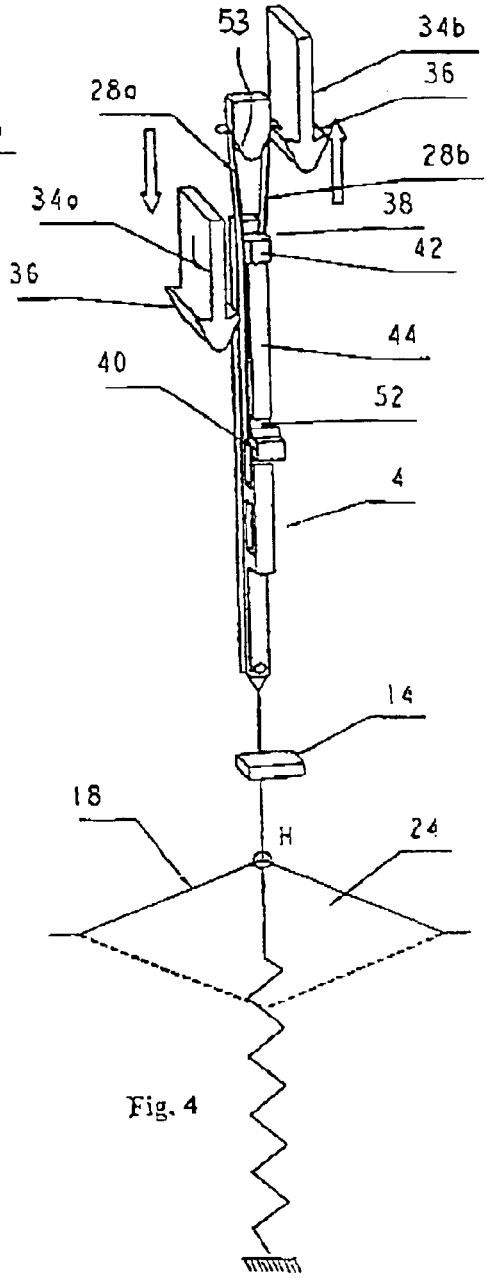
FIG. 4 shows the lifter of FIG. 1 in the upper shed position, in a modified diagrammatic illustration.

FIG. 4 shows an important state of the lifting knife in its highest position, the lifter being just above the upper shed position. If the lifter is to remain selectively in the upper shed position, the actuator 40 is reactivated and interlocks with the catch 52, with the result that the lifter can no longer follow the lifting knife during the return of the latter. The entire mechanism has a small overmovement at the upper shed position, said overmovement facilitating, on the one hand, a coupling and uncoupling of the spring arms of the lifting knives and, on the other hand, the actuation of the actuator 40, since the elements to be switched are relieved of the tensile forces at the heddle. To lower the lifter out of the upper shed position, one of the lifting knives can grasp the hook 32 of a spring arm, since, by virtue of an upper fixed spreading member with run-on surfaces 53, the spring arms are deflected into the displacement path of the lifting knives 34*a*, 34*b*. The lifting knife then raises the displacement member 4 and consequently the lifter 2 according to the small overmovement and thus makes it easier for the actuator 40 to be disengaged, whereupon the lifter can follow the downward movement of the lifting knife. When the lifter 2 stands at the lower stop, the lifting knives 34*a* and 34*b* likewise execute a small downward overmovement in the lower shed position, with the result that the uncoupling of the spring arms from the lifting knives is facilitated, so that the spring arms can spring back into the basic position. It is thereby possible for a lifting knife to be raised out of the lower shed position, without cooperation with a spring arm and without the lifter being raised. It is also possible to control the switch member in such a way that the spring arm either dwells in the coupled position or is moved into this position before the lifting knife has passed the coupling level, so that the lifter is raised out of the lower shed position during the next shot of a weft thread through the shed.

The known double-lift technique is therefore possible in a simple way by means of the present design of the jacquard machine.

Figure 5:
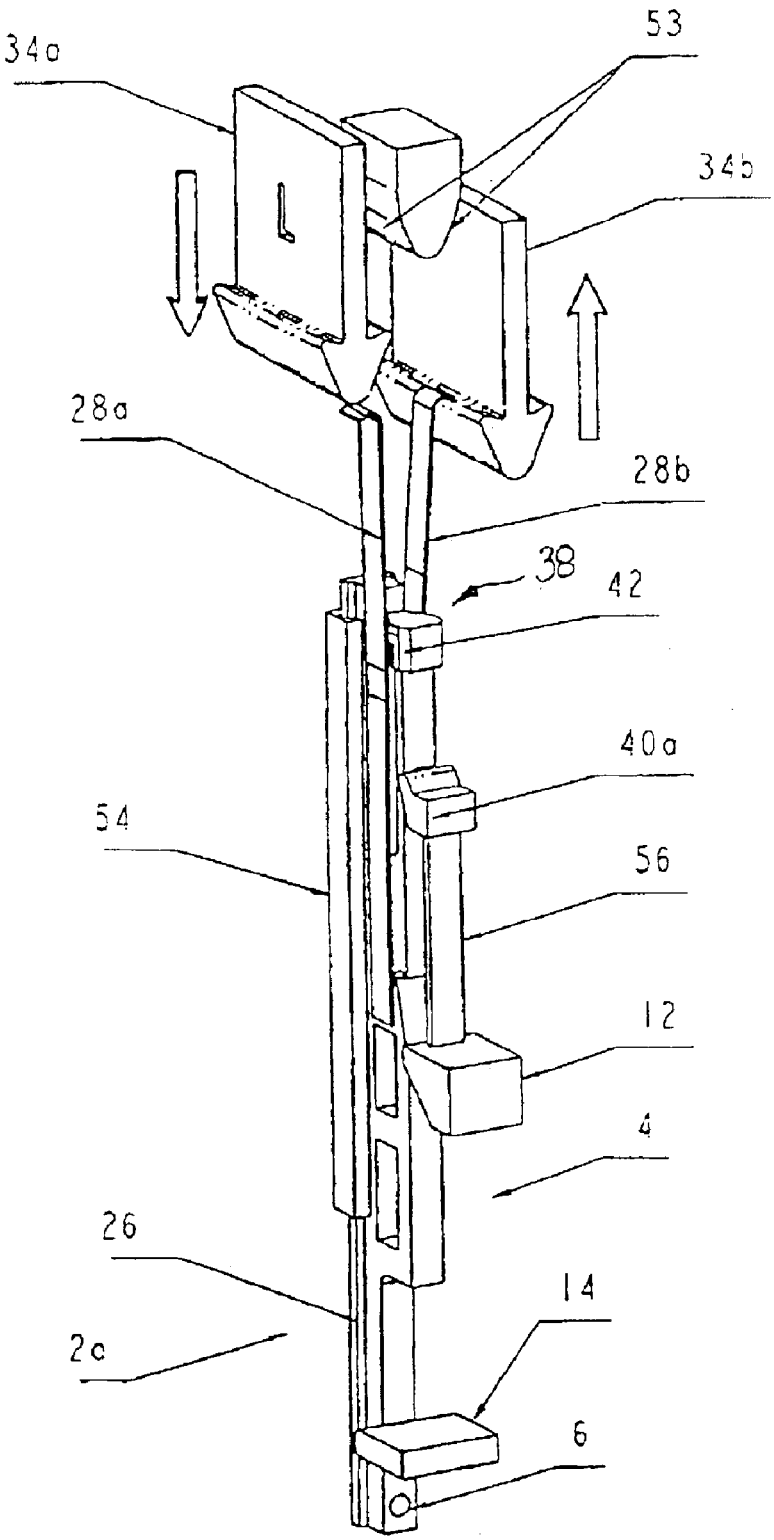
FIG. 5 shows a modified lifter in the middle shed position, with an actuator designed as a piezoelectric element, in a modified diagrammatic illustration.

FIG. 5 shows the lifter 2 of FIGS. 1 to 4, which is guided with its back part 26 in a guide 54 fastened to the machine stand 12. Moreover, in the example of FIG. 5, the actuator 40*a* is not designed as part of an electromagnet, but as part of a piezoelectric element 56 which is likewise fastened fixedly to the machine stand 12.

Figure 6:
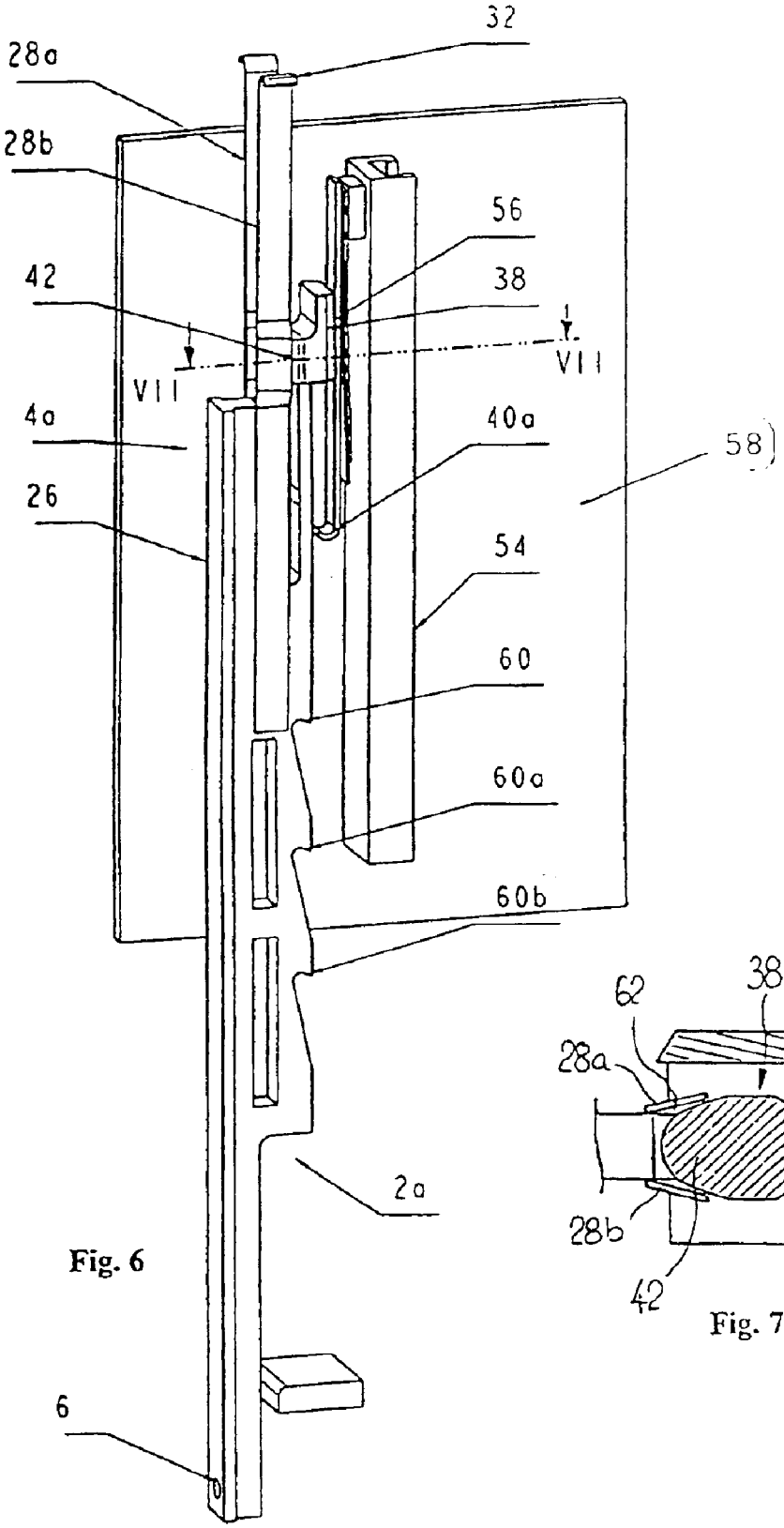
FIG. 6 shows a modified lifter on a machine stand in a diagrammatic illustration.
Figure 7:
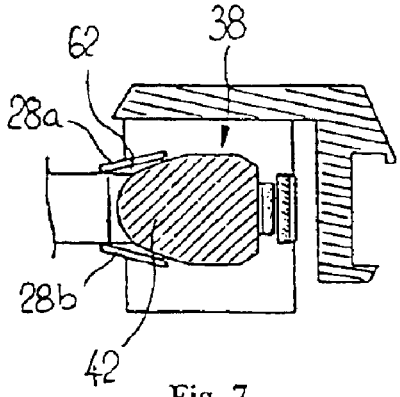
FIG. 7 shows the switch member of FIG. 6 as a detail and in the section VII—VII of FIG. 6.

FIGS. 6 and 7 show a modified lifter 2*a* of FIG. 5, the guide 54 being arranged on a plate 58 of the machine stand 12. In this case, the arrangement is such that the guide 54 of a lifter also serves at the same time as a holding device for the piezoelectric element 56 of the adjacent lifter. The lifter 2*a* or the displacement member 4*a* of the lifter of FIG. 6 has a plurality of catches 60, 60*a*, 60*b* which are distributed over the height and on which the actuator 40*a* can catch. The catches 60, 60*a*, 60*b* arranged at different heights allow a correspondingly differentiated opening of the shed over a correspondingly different shed height, since the shed height is equal to the distance which corresponds to the raising of the lifter out of the lower shed position of FIG. 1 into the upper shed position of FIG. 4. A different shed height also makes it necessary, of course, for the lifting knives to execute a correspondingly adapted lift. The shed height may, under certain circumstances, also be increased downward by the lower stop being downwardly adjustable. Here, too, the lift of the lifting knives must be adapted to a changed position of the lower stop.

It may be gathered from FIG. 7 that the spreading wedge 42 of the switch member 38 cooperates with correspondingly beveled switch surfaces 62 of the spin arms 28*a* and 28*b*.

| List of reference symbols | |
|---|---|
| T | Lower shed position |
| M | Middle shed position |
| H | Upper shed position |
| 2 | Lifter |
| 2a | Lifter |
| 4 | Displacement member |
| 4a | Displacement member |
| 6 | Loop |
| 8 | Heddle |
| 10 | Spring |
| 12 | Machine stand |
| 14 | Lower stop |
| 16 | Eye |
| 18 | Warp thread |
| 24 | Shed |
| 26 | Back part |
| 28a | Spring arm |
| 28b | Spring arm |
| 30 | Coupling means |
| 32 | Hook |
| 34a | Lifting knife |
| 34b | Lifting knife |
| 36 | Driver |
| 38 | Switch member |
| 40 | Actuator |
| 40a | Actuator |
| 42 | Spreading wedge |
| 44 | Spring tongue |
| 46 | Electromagnet |
| 48 | Line |
| 50 | Control device |
| 52 | Catch |
| 53 | Run-on surfaces |
| 54 | Guide |
| 56 | Piezoelectric element |
| 58 | Plate |
| 60 | Catch |
| 60a | Catch |
| 60b | Catch |
| 62 | Switch surface |

What is claimed is:

1. A jacquard machine comprising:

an actuator;

oppositely ascending and descending lifting knives; and lifters which can be connected to threads to be controlled and which can be coupled, corresponding to control signals from an electronic control device, in a form-fitting manner to said oppositely ascending and descending lifting knives, each lifter having a displacement member which can be connected to at least one thread to be controlled and which carries two spring arms which in the basic position are free of the lifting knives by means of a switch member capable of being actuated by said actuator, and in the upper shed position the displacement member being interlockable by means of the actuator, wherein the switch member is arranged at the end of a spring tongue oriented in the direction of displacement and fastened to the displacement member outside the spring arms, the actuator being arranged laterally outside the spring arms and so as to act transversely thereto.

2. The jacquard machine as claimed in claim 1, including at least one rigid catch, with which the actuator cooperates directly, is arranged on the displacement member for detention of the actuator in the upper shed position.

3. The jacquard machine as claimed in claim 1, wherein the displacement member has at least two catches arranged at different heights.

4. The jacquard machine as claimed in claim 1, wherein the actuator is part of an electromagnet.

5. The jacquard machine as claimed in claim 1, wherein the actuator is part of a piezoelectric element.

6. The jacquard machine as claimed in claim 1, wherein the jacquard machine has run-on surfaces which keep the spring arms spread in the coupling position when in the upper shed position.

7. The jacquard machine as claimed in claim 1, wherein the lifter is assigned a settable stop determining the lower shed position.

8. The jacquard machine as claimed in claim 1, wherein the displacement member has, on the side facing away from the actuator, a back part which is equipped with a guide profile and which is mounted displaceably in a guide in a machine stand.

9. The jacquard machine as claimed in claim 1, wherein the lifting knives are designed to execute an overmovement in at least one of the upper shed position and the lower shed position.

10. The jacquard machine as claimed in claim 2, wherein the actuator is part of an electromagnet.

11. The jacquard machine as claimed in claim 2, wherein the actuator is part of a piezoelectric element.

12. The jacquard machine as claimed in claim 2, wherein the jacquard machine has run-on surfaces which keep the spring arms spread in the coupling position when the lifter is in the upper shed position.

13. The jacquard machine as claimed in claim 2, wherein the lifter is assigned a settable stop determining the lower shed position.

14. The jacquard machine as claimed in claim 2, wherein the displacement member has a side facing away from the actuator having a back part which is equipped with a guide profile and which is displaceably mounted in a guide in a machine stand.

15. The jacquard machine as claimed in claim 2, wherein the lifting knives are designed to execute an overmovement in one of the upper shed position and the lower shed position.

16. The jacquard machine as claimed in claim 2, wherein the actuator is part of an electromagnet.

17. The jacquard machine as claimed in claim 3, wherein the actuator is part of a piezoelectric element.

18. The jacquard machine as claimed in claim 3, wherein the jacquard machine has run-on surfaces which keep the spring arms spread in the coupling position when the lifter is in the upper shed position.

19. The jacquard machine as claimed in claim 3, wherein the lifter is assigned a settable stop determining the lower shed position.

20. The jacquard machine as claimed in claim 3, wherein the displacement member has a side facing away from the actuator having a back part which is equipped with a guide profile and which is displaceably mounted in a guide in a machine stand.

21. The jacquard machine as claimed in claim 3, wherein the lifting knives are designed to execute an overmovement in one of the upper shed position and the lower shed position.

* * * * *